US011437728B1

(12) United States Patent
Du et al.

(10) Patent No.: US 11,437,728 B1
(45) Date of Patent: Sep. 6, 2022

(54) MULTI-BAND QUADRIFILAR HELIX SLOT ANTENNA

(71) Applicant: Atlanta RFtech LLC, Snellville, GA (US)

(72) Inventors: Xin Du, Snellville, GA (US); Huiming Song, Snellville, GA (US)

(73) Assignee: ATLANTA RFTECH LLC, Snellville, GA (US)

( * ) Notice: Subject to any disclaimer, the term of this patent is extended or adjusted under 35 U.S.C. 154(b) by 0 days.

(21) Appl. No.: 17/213,826

(22) Filed: Mar. 26, 2021

(51) Int. Cl.
*H01Q 13/12* (2006.01)
*H01Q 11/08* (2006.01)
*H01Q 1/36* (2006.01)

(52) U.S. Cl.
CPC ..... *H01Q 13/12* (2013.01); *H01Q 1/36* (2013.01); *H01Q 11/08* (2013.01)

(58) Field of Classification Search
CPC ..... H01Q 13/12; H01Q 1/36; H01Q 11/08
See application file for complete search history.

(56) References Cited

U.S. PATENT DOCUMENTS

| | | | | |
|---|---|---|---|---|
| 5,955,997 A | | 9/1999 | Ho et al. | |
| 6,088,000 A | | 7/2000 | Ho | |
| 6,157,346 A | * | 12/2000 | Ho | H01Q 13/10 343/895 |
| 6,160,523 A | | 12/2000 | Ho | |
| 6,653,987 B1 | | 11/2003 | Lamensdorf et al. | |
| 7,525,508 B2 | | 4/2009 | Sharaiha et al. | |
| 9,905,932 B2 | | 2/2018 | DiNallo | |
| 2019/0148833 A1 | * | 5/2019 | Klein | H05K 1/028 343/702 |

FOREIGN PATENT DOCUMENTS

| | | | | |
|---|---|---|---|---|
| CN | 201523073 U | * | 7/2010 | H01Q 13/00 |
| CN | 210628506 U | * | 5/2020 | H01Q 21/28 |
| EP | 3522298 A1 | * | 8/2019 | H01Q 1/362 |

OTHER PUBLICATIONS

C. H. Ho, "Microstrip-Fed Cylindrical Slot Antennas for GPS Avionics Applications" IEEE AP-S 1997, pp. 2214-2217.

Tranquilla, James et al., "A Study of the Quadrifilar Helix Antenna for Global Positioning System (GPS) Applications," IEEE Transactions on Antennas and Propagation, vol. 38, No. 10, p. 1545 (Oct. 1990).

C. Kilgus, "Shaped-conical radiation pattern performance of the backfire quadrifilar helix", IEEE Transactions on Antennas and Propagation, vol. 23, Issue: 3 (May 1975).

C. C. Kilgus, "Resonant quadrifilar helix design", Microwave J., vol. 13-12, pp. 49-54 (Dec. 1970).

C. C. Kilgus, "Resonant quadrifilar helix", IEEE Trans. Antennas and Propagation. (Communication), vol. AP-17, pp. 349-351 (May 1969).

* cited by examiner

*Primary Examiner* — Hoang V Nguyen
(74) *Attorney, Agent, or Firm* — Finnegan, Henderson, Farabow, Garrett & Dunner LLP

(57) ABSTRACT

A quadrifilar helix antenna may comprise a cylindrical body with a conductive layer. The antenna may further comprise a first slot disposed on the cylindrical body, wherein a length of the first slot is proportional to a first wavelength of a first signal. The antenna may further comprise a second slot disposed on the cylindrical body. The antenna may further comprise a first feed line crossing the first slot. The antenna may further comprise a second feed line crossing the second slot.

20 Claims, 10 Drawing Sheets

MULTI-BAND QUADRIFILAR HELIX SLOT ANTENNA

FIELD OF INVENTION

The disclosed inventions generally relate to L band communications satellite antennas, such as those used for the Global Navigation Satellite System ("GNSS"), including Global Positioning System ("GPS"), Global Navigation Satellite System ("GLONASS"), Galileo, and BeiDou, among others. Disclosed embodiments more particularly relate to a dual-band slot quadrifilar helix antenna ("QHA") for use in these types of systems.

BACKGROUND OF THE INVENTION

Quadrifilar Helix Antennas ("QHA") were introduced by C. C. Kilgus in the 1970s to accommodate GNSS satellites orbiting on non-geosynchronous orbits in three papers: C. C. Kilgus, *Shaped-conical radiation pattern performance of the backfire quadrifilar helix,* 23 IEEE Trans. on Antennas and Propagation, 392 (1975); C. C. Kilgus, *Resonant quadrifilar helix design,* 13 Microwave J., 49 (1970); and C. C. Kilgus, *Resonant quadrifilar helix*, AP-17 IEEE Trans. Antennas and Propagation, 349 (1969). The content of each of these papers is incorporated by reference in its entirety.

QHA can be a simple but effective antenna. As shown in FIG. 1, a typical QHA comprises four, or two pairs of, helix conductors fixed on a bracket. In this structure, the feeding network can receive signals having equal or approximately equal amplitude but 0°, 90°, 180°, and 270° phase differentials, minimizing potential phase center variation. In precision GNSS applications, such as survey devices and reference stations, the stability of the phase center can be critical because an unwanted phase center variation may result in positional errors. QHA is also preferred for receiving GNSS signals because it can be lighter in weight, has good circular polarization, and has a wide beam width. These advantages make QHA a preferred portable antenna for receiving signals from non-geosynchronous satellites of GNSS systems.

GNSS has been widely used in various systems, such as automobile and truck navigation, deep-sea vessel tracking, and air traffic control. The rapid advancement of GNSS-related technologies has also supported or enabled further applications, such as GNSS-enabled smartphones, autonomous driving, smart agriculture, logistics management, surveying, construction, sports equipment, field workforce management, unmanned aerial vehicles, and high-speed railway systems, among others.

A growing number of GNSS systems are available throughout the world, including, for example, GPS by the United States, GLONASS by Russia, Galileo by Europe, and BeiDou by China.

In general, GNSS signals are right-hand circular polarized, which means the electromagnetic field of the wave has an approximately constant magnitude and is rotating at a constant rate clockwise when traveling away from an observer. GNSS signals' frequencies may vary depending on system configurations. The radio frequencies for the major systems are listed below, in MHz:

| | | |
|---|---|---|
| GPS (U.S.): | L1 C/A | 1575.42 |
| | L2 C | 1227.6 |
| | L2 P | 1227.6 |
| | L5 | 1176.45 |

-continued

| | | |
|---|---|---|
| GLONASS (Russia): | L1 C/A | 1598.0625-1609.3125 |
| | L2 C | 1242.9375-1251.6875 |
| | L2 P | 1242.9375-1251.6875 |
| | L3 OC | 1202.025 |
| Galileo (Europe): | E1 | 1575.42 |
| | E5a | 1176.45 |
| | E5b | 1207.14 |
| | E5 AltBOC | 1191.795 |
| | E6 | 1278.75 |
| BeiDou (China): | B1I | 1561.098 |
| | B2I | 1207.14 |
| | B3 | 1268.52 |
| | B1C | 1575.42 |
| | B2a | 1176.45 |
| NAVIC: | L5 | 1176.45 |
| SBAS: | L1 | 1575.42 |
| | L5 | 1176.45 |
| QZSS (Japan) | L1C/A | 1575.42 |
| | L1 C | 1176.45 |
| | L1S | 1575.42 |
| | L2C | 1227.6 |
| | L5 | 1176.45 |
| | L6 | 1278.75 |

In addition to being able to receive signals on one or more of the above frequencies, it is often desirable for a receiving device to be capable of receiving signals in multiple bands. For certain precision GNSS applications, the receiving device must simultaneously receive signals in multiple bands to perform Real-Time Kinematic positioning, a satellite navigation technique used to enhance the precision of position data derived from GNSS.

As a result, it is highly desirable to have one antenna covering at least the entirety of the above-mentioned bands, e.g., 1164-1610 MHz. However, an antenna covering the full band of 1164-1610 MHz may not always be necessary because none of the major GNSS systems utilize the 1300-1525 MHz band. Therefore, the industry has adopted a dual-band design, which has a lower band at 1164-1300 MHz and a higher band at 1525-1610 MHz. In some applications, this dual-band antenna may achieve a similar level of effectiveness as that of a full-band antenna.

The industry has made many attempts to combine high- and low-band antennas. One such combination is to place one QHA on top of another in a "piggybacked" arrangement to receive the signals in multiple bands. However, a study by James M. Tranquilla and Steven R. Best (*A Study of the Quadrifilar Helix Antenna for Global Positioning System (GPS) Applications,* 38 IEEE Trans. on Antennas and Propagation, 1545 (1990)) suggests that "piggybacked" QHAs are not preferred. This is because the interactions between the two QHAs may reduce the combined antenna performance. Specifically, the back lobe of the combined QHA may increase, increasing potential interference from the surrounding environment. The phase and phase center variation may also increase, increasing the likelihood of positional errors.

To design a better dual-band antenna, extensive research has been undertaken by entities including Qualcomm, MITRE, University of Rennes, and Maxtena. The research focused primarily on dipole or monopole conductor antennas, or their variations. However, antennas with a "complementary" structure (i.e., "window" or slot radiator surrounded by conductor) have not been extensively investigated. Slot antennas may have better resistance to interference from the surrounding environment. The benefits of these antennas may further include, in some configurations, reducing the need for a ground plane (counterpoise) because the antenna body can be a conductive ground.

Garmin engineers also conducted research on single-band QHA with the complementary structure in the late 1990s. The research resulted in several patents: U.S. Pat. No. 5,955,997 to Ho, et al.; U.S. Pat. No. 6,157,346 to Ho; U.S. Pat. No. 6,088,000 to Ho; and U.S. Pat. No. 6,160,523, which are incorporated by reference in their entirety. However, there is limited research on improving this type of antenna to extend its bandwidth. To fill this gap, this disclosure provides an improved QHA with two or more band slots.

SUMMARY OF THE INVENTION

In the following description, certain aspects and embodiments of the present disclosure will become evident. It should be understood that the disclosure, in its broadest sense, could be practiced without having one or more features of these aspects and embodiments. It should also be understood that these aspects and embodiments are merely exemplary.

An exemplary quadrifilar helix antenna is disclosed. The antenna may include a cylindrical body with a conductive layer. The antenna may further include a first slot disposed on the cylindrical body, wherein a length of the first slot is proportional to a first wavelength of a first signal. The antenna may further include a second slot disposed on the cylindrical body, wherein a length of the second slot is proportional to a second wavelength of a second signal, the second wavelength of the second signal is different from the first wavelength of the first signal, wherein the second slot is substantially parallel to the first slot and wherein the length of the second slot is different from the length of the first slot. The antenna may further include a first feed line crossing the first slot. The antenna may further include a second feed line crossing the second slot.

Disclosed exemplary embodiments may also include a half wavelength quadrifilar helix antenna. The antenna may further include a cylindrical body with a conductive layer. The antenna may further include a first slot disposed on the cylindrical body, wherein a length of the first slot is approximately one half of a first wavelength of a first signal. The antenna may further include a second slot disposed on the cylindrical body, wherein a length of the second slot is approximately one-half of a second wavelength of a second signal and wherein the length of the second slot is different from the length of the first slot. The antenna may further include a first feed line crossing the first slot. The antenna may further include a second feed line crossing the second slot.

Disclosed exemplary embodiments may also include a quarter wavelength quadrifilar helix antenna. The antenna may further include a cylindrical body with a conductive layer. The antenna may further include a base attached to a lower end of the cylindrical body. The antenna may further include a first slot disposed on the cylindrical body, wherein a length of the first slot is approximately one quarter of a first wavelength of a first signal. The antenna may further include a second slot disposed on the cylindrical body, wherein a length of the second slot is approximately one quarter of a second wavelength of a second signal and wherein the length of the second slot is different from the length of the first slot. The antenna may further include a first feed line crossing the first slot. The antenna may further include a second feed line crossing the second slot.

DETAILED DESCRIPTION OF THE INVENTION

Figure 1:
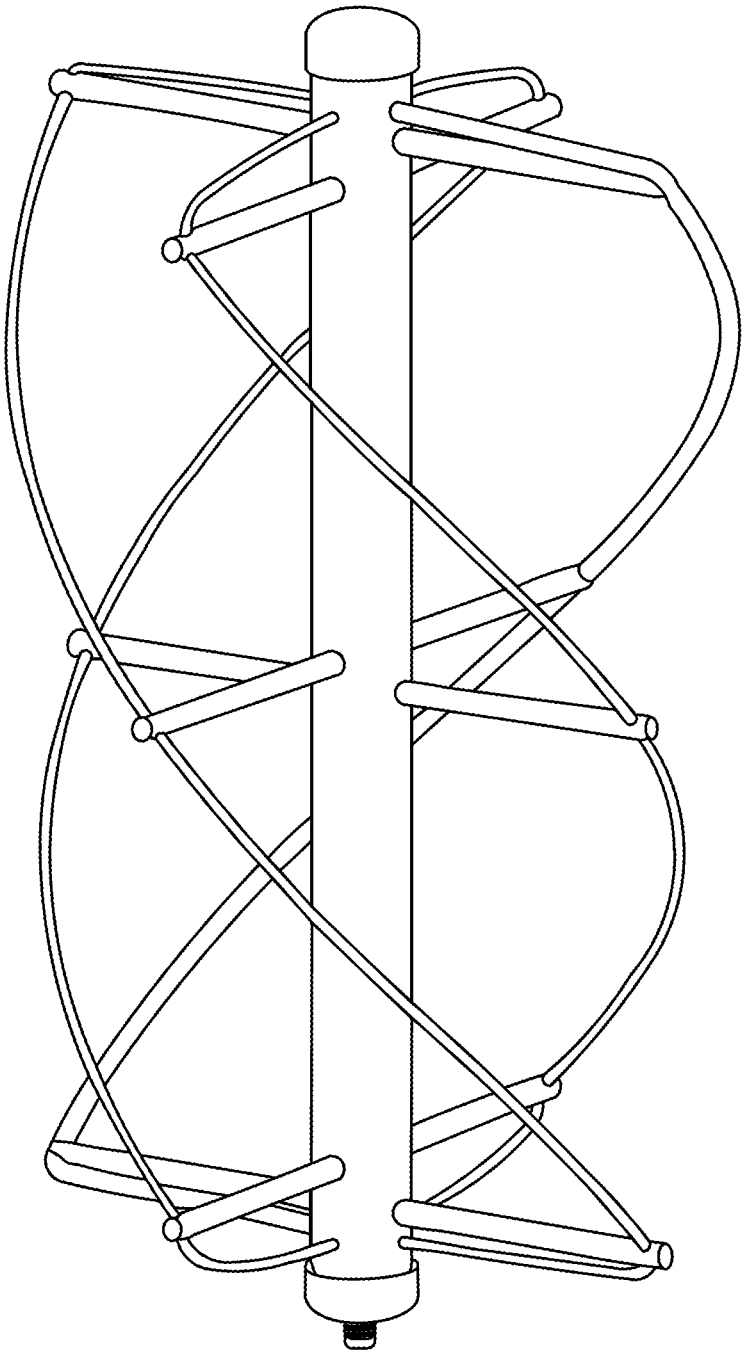
FIG. 1 is a perspective 3D view of a conventional QHA.
Figure 2:
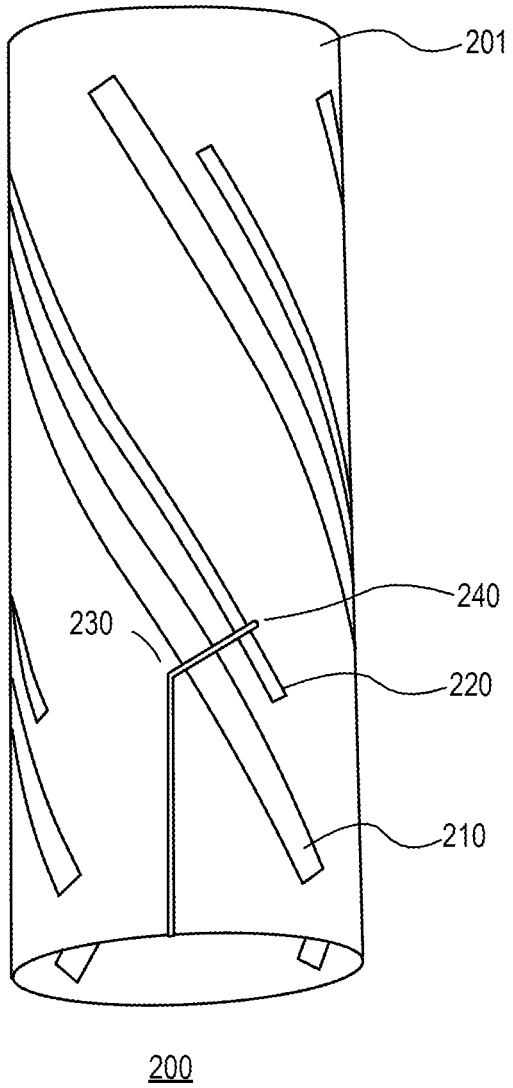
FIG. 2 is a perspective 3D view of an exemplary half-wavelength antenna 200 in accordance with an embodiment of the present invention.

FIG. 2 is a perspective 3D view of an exemplary half-wavelength antenna 200 in accordance with an embodiment of the present invention. The half-wavelength antenna 200 is an improved antenna with a complementary structure of a traditional dipole conductor QHA. Babinet's principle relates two antennas with a complementary structure. The dipole or monopole input impedance ($Z_I$) and the complementary slot impedance ($Z_s$) with same dimension satisfy the following equation:

$$Z_I \times Z_s = \eta^2/4$$

where $\eta$ is the intrinsic impedance of free space, having a value of $120\pi$. For example, the complementary structure of a halfwave dipole with impedance of 73 Ohms is a slot with impedance of about 487 Ohms.

As shown in FIG. 2, the antenna body 201 may be a cylindrical tube with slots having specific sizes, shapes, and relationships to provide improved antenna functionality. In some embodiments, the top and bottom ends of the tube may be open, while in other embodiments, the top end, the bottom end, or both may be covered with one or more conductive caps (although the conductive caps are not shown in FIG. 2). In some embodiments, the antenna body 201 may be partially or completely coated with or filled with insulative materials, such as ceramics, while in other embodiments, it is not coated or filled.

The antenna body 201 may be made of materials with at least one conductive layer. In some embodiments, the antenna body 201 may be made of a cylindrical ceramic core coated with a conductive layer. In a preferred embodiment, the body of the antenna may be made of a double-sided flexible printed circuit board ("PCB"). Preferably, the substrate of the flexible PCB is made from polyimide with a dielectric constant of 3.5 and with thickness of 5-10 mil (where a "mil" is one thousandth of an inch). The one or more conductive layers of the flexible PCB may be made from copper or other conductive materials.

The antenna body 201 further comprises a lower-band slot 210, a higher-band slot 220, and feed lines 230 and 240. Each of the slots may be extended, in a helical configuration, by approximately one-half turn around the antenna body 201. In the preferred embodiment, the lower-band slot 210 and higher-band slot 220 are etched, in a helical configuration, on the inner side of the flexible PCB. The feed lines 230 and 240 may be microstrip lines etched on the outer side of the flexible PCB. As explained below, the antenna body 201 comprises four lower-band slots, four higher-band slots, and eight feed lines, with all the slots and feed lines shown in FIG. 3.

Figure 3:
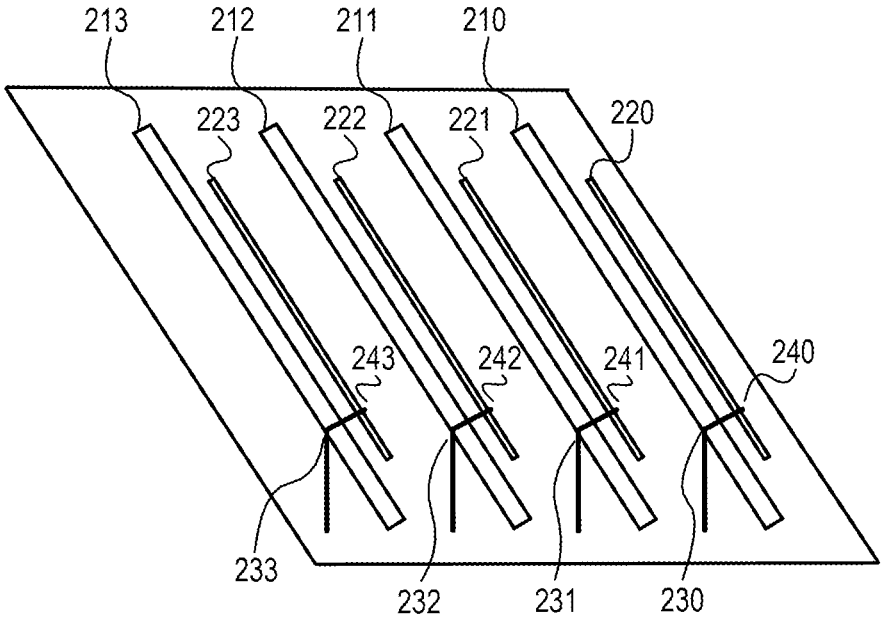
FIG. 3 is a plan view of an unfolded antenna body 201 of the exemplary half-wavelength antenna 200 described with reference to FIG. 2.

FIG. 3 is a plan view of an unfolded antenna body 201 of the exemplary half-wavelength antenna 200 described with reference to FIG. 2. As shown in FIG. 3, the height of the antenna body 201 may be approximately half of the wavelength of the signals the antenna 200 is designed to receive. The circumference of the antenna body 201 corresponds to the widths of the slots, the distances between the slots, and the angles of the slots. In a preferred embodiment, the height of the antenna body 201 may be 110 mm and the circumference may be 2*pi*36.5 mm. As shown in FIG. 3, the higher-band slots 210-213 and lower-band slots 120-123 may be substantially parallel. The length of lower-band slots 210-213 may be approximately half of the average wavelength of the signals in the lower frequency band (e.g., 1164-1300 MHz). In a preferred embodiment, the length of the lower-band slots 210-213 may be 115 mm, and the width may be 4 mm. The length of higher-band slots 220-223 may be approximately half of the average wavelength of the signals in the higher frequency band (e.g., 1525-1610 MHz). In a preferred embodiment, the length of the higher band slots 220-223 may be 80 mm, and the width may be 2 mm.

Each slot may be associated with a feed line. The lower-band slots 210-213 may be associated with feed lines 230-233, respectively. The higher-band slots 220-223 may be associated with feed lines 240-243, respectively. Preferably, each feed line forms a short circuit through a metalized member (e.g., a via) at the top end of each feed line. In some embodiments, the feed lines 240-243 may be combined with feed lines 230-233, respectively, to form a four-port antenna, as shown in FIGS. 2 and 3. In this case, each combined feed line may be associated with two metalized members. One end of each combined feed line may be further connected to a feeding network (although the feeding network is not shown in FIGS. 2 and 3). When using this structure, known measures should be applied to cancel the joint point admittance because of the diplexing feature of this embodiment. In some embodiments, one end of each feed lines 230-233 and 240-243 may be connected independently to a feeding network (although these embodiments are not shown in FIGS. 2 and 3).

Each of the feed lines 230-233 may be placed across the associated slot and close to one end of the slot. Preferably, a feed line may be placed close to the lower end of a slot because the impedance caused by the slot is lower (e.g., 50 Ohms) at the lower end of the slot due to the sinusoidal distribution of the electric field along the slot. For example, in a preferred embodiment, each of the feed lines 230-233 may be routed so an end is perpendicular to an associated slot and about 8.5 mm from the lower end of the associated slot.

Similarly, each of the feed lines 240-243 may be placed across the associated slot and close to one end of the slot. For example, in a preferred embodiment, each of the feed lines 240-243 may be routed so an end is perpendicular to the associated slot and about 1.4 mm from the lower end of the associated slot.

Preferably, each of the feed lines 230-233 and 240-243 may match the impedance of the associated slot (e.g., 50 Ohms). For example, each of the feed lines may be a 0.6 mm wide strip on a 10 mil flexible PCB. The feeding network connected to the feed lines may simultaneously receive signals with equal or approximately equal amplitude but having 0°, 90°, 180°, and 270° phase differentials.

While the height of the antenna body 201 and lengths of the slots on the antenna body 201 are approximately half of the wavelength of signals the antenna 200 is designed to receive, integer multiples of the height and lengths are also in accordance with the disclosed embodiments of the invention. For example, those skilled in the art will appreciate that an antenna with doubled height (e.g., 2110 mm), doubled lower-band slot lengths (e.g., 2115 mm), and doubled higher-band slot lengths (e.g., 2*80 mm) is in accordance with the disclosed embodiments of the invention. The same is true for other integer multiples, such as 3×, 4×, 5×, etc. While four sets of slots are discussed in detail in this disclosure, those skilled in the art will appreciate that the antennas with six, eight, or more sets of slots are in accordance with the disclosed embodiments of the invention.

Figure 4:
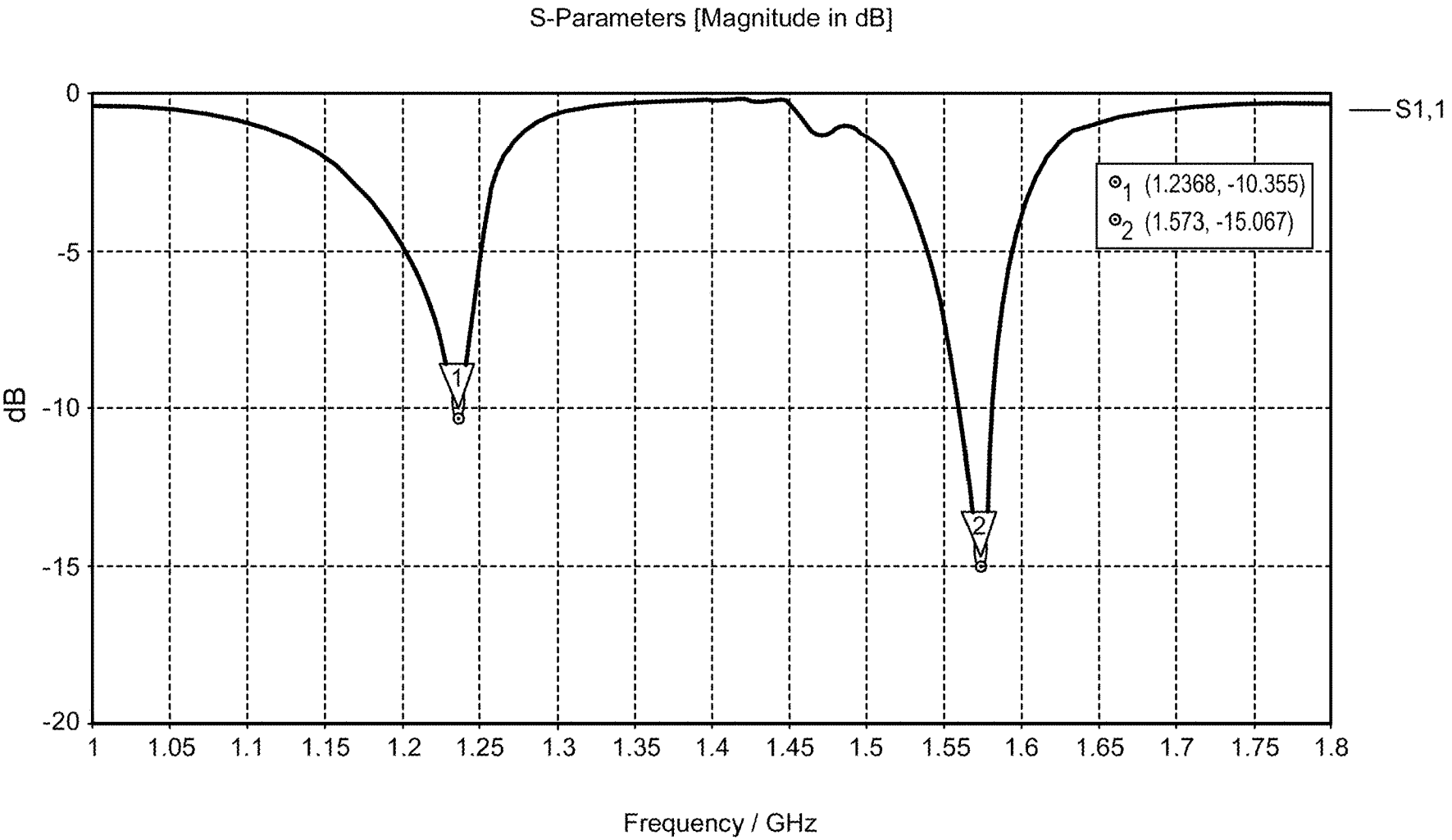
FIG. 4 shows the return loss of an exemplary antenna in accordance with the embodiment of FIG. 2.

FIG. 4 shows the return loss of an exemplary antenna in accordance with the embodiment of FIG. 2. In FIG. 4, the horizontal (x) axis represents frequency in GHz of a received signal and the vertical and the vertical (y) axis represents return loss of a signal at the specified frequency. As shown in FIG. 4, signals whose frequencies fall within 1164-1300 MHz and 1525-1610 MHz have a greater return loss than signals outside the delineated ranges, with a maximum return loss around 10 dB and 15 dB, respectively. Also as shown in FIG. 4, signals within 1300-1450 MHz have a low return loss, representing a more ideal port isolation of the antenna. The return loss is reported by simulations run on CST Microwave Studio 2020.

Figure 5:
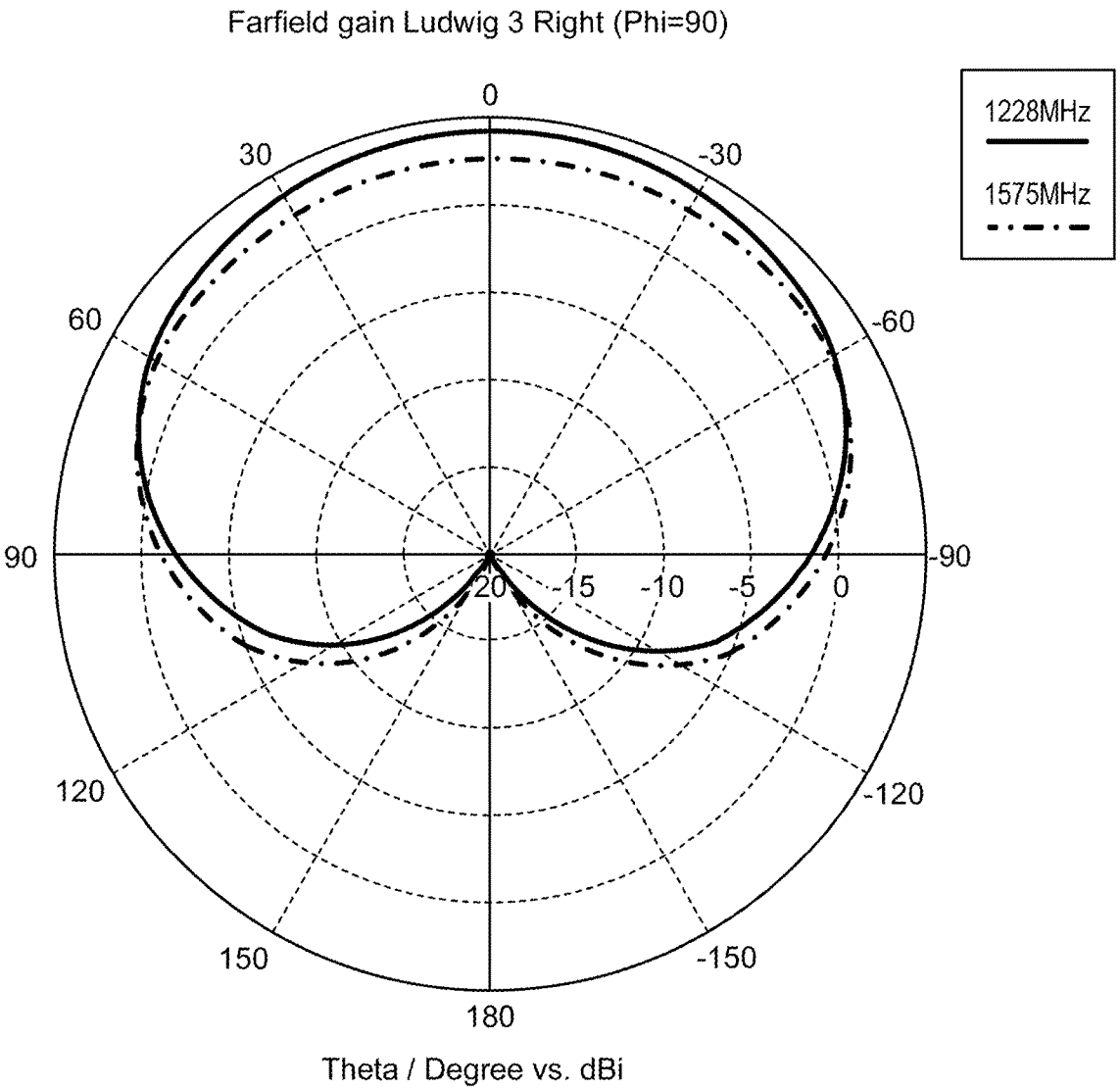
FIG. 5 shows a right-hand circular polarized pattern at lower- and higher-frequency bands of an exemplary antenna in accordance with the embodiment of FIG. 2.

FIG. 5 shows a right-hand circular polarized pattern at lower- and higher-frequency bands of an exemplary antenna in accordance with the embodiment of FIG. 2. As shown in FIG. 5, a broad axial beam is obtained with a half-power beamwidth of more than 120° and the front-back ratio is more than 20 dB, which shows a good resistance to multipath interference, which includes interference caused by refracted signals. The pattern is reported by simulations run on CST Microwave Studio 2020 with a calibrated right-hand circularly polarized helical antenna.

Figure 6:
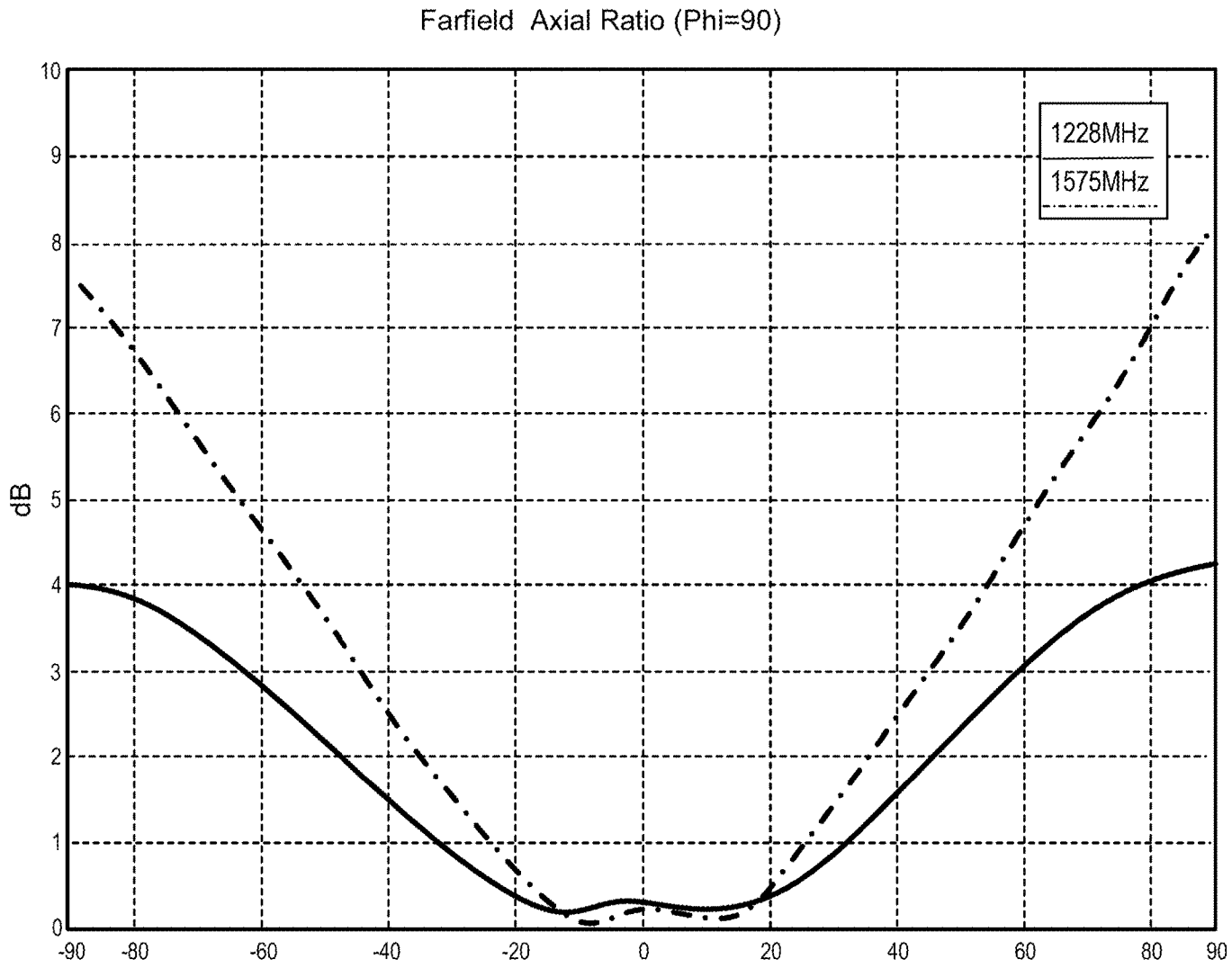
FIG. 6 illustrates the lower- and higher-frequency band axial ratios of an exemplary antenna in accordance with the embodiment of FIG. 2.

FIG. 6 illustrates the lower- and higher-frequency band axial ratios of an exemplary antenna in accordance with the embodiment of FIG. 2. As shown in FIG. 6, the axial ratio of the antenna is less than 3 dB for +/−60 degrees from the main beam, indicating that, within a range of 120 degrees, the circular polarization of a signal deviates only a small degree.

Figure 7:
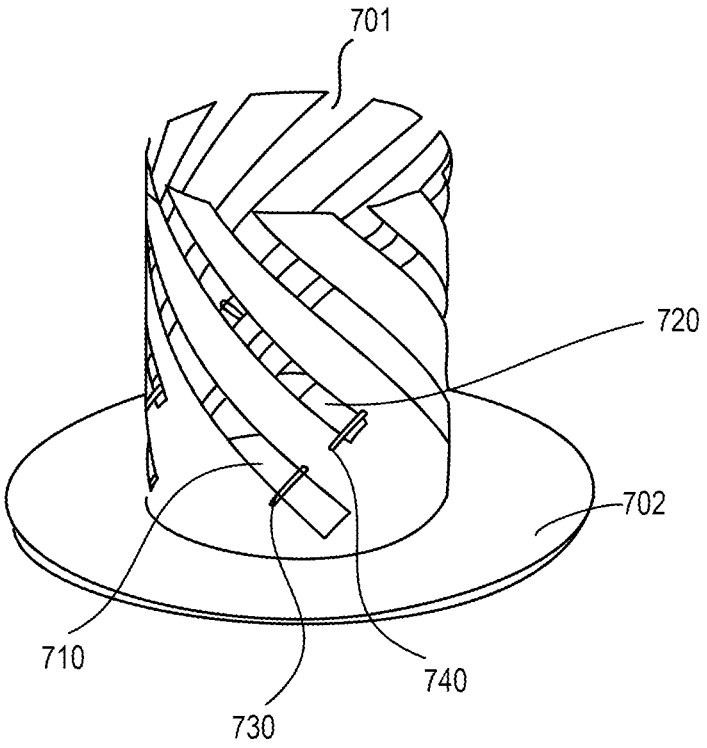
FIG. 7 is a perspective 3D view of an exemplary quarter-wavelength antenna 700 in accordance with an embodiment of the present invention.

FIG. 7 is a perspective 3D view of an exemplary quarter-wavelength antenna 700 in accordance with an embodiment of the present invention. The antenna 700 is an improved antenna with a complementary structure of a traditional monopole conductor QHA. As shown in FIG. 7, the antenna 700 may comprise an antenna body 701 and a grounded base

702 (although non-conductive components are not shown in FIG. 7). The antenna body 701 may be similar to the antenna body 201 but with a few differences. For example, while the materials used to make both antennas may be the same, the height of the antenna body 701 may be approximately one quarter of the wavelength of the signals it is designed to receive (i.e., half of the height of the antenna body 201). In a preferred embodiment, the height of the antenna body 701 is 45 mm and the diameter is 36 mm.

Etched on the antenna body 701 are slots with open top ends, comprising a lower-band slot 710 and a higher-band slot 720. Each of the slots may be rolled approximately by a quarter turn around the antenna body 701. The length of each of the slots may be approximately quarter of wavelength of signals it is designed to receive. In a preferred embodiment, the length of the lower-band slot 710 may be 63 mm, and the width may be 4 mm. The length of the higher-band slot 720 may be 42.5 mm, and the width may be 3 mm. Three additional similar or identical lower-band slots and three additional higher-band slots are spaced around the antenna at intervals approximately equal to one quarter of the circumference of the antenna. In some embodiments, each of the slots is associated with a feed line. Preferably, two feedlines are separate as shown in FIG. 7, but, in another embodiment, the feed lines may be joined as one single feed line. The feed lines may be placed and connected in a similar manner discussed with reference to FIGS. 2 and 3.

The base 702 is connected to the lower end of the antenna body 701. In some embodiments, the base 702 may be a plate with a conductive layer connected to ground. Those skilled in the art will appreciate that the antenna body 701 is also connected to ground at least through its connection to grounded base 702. In some embodiments, the base 702 may have a feeding network attached to the bottom of the base 702 (although this particular arrangement for the feeding network is not shown). In some embodiments, the base 702 may be made of similar materials as the antenna body 702.

While the height of the antenna body 701 and length of the associated slots are approximately one quarter of the wavelength of signals the antenna is designed to receive, odd integer multiples of the height and the length are equally applicable to the antenna in accordance with the disclosed embodiments of the invention. For example, those skilled in the art will appreciate that antenna with tripled height (e.g., 3*45 mm), tripled lower-band slot lengths (e.g., 3*63 mm), and tripled higher-band slot lengths (e.g., 3*42.5 mm) is in accordance with the disclosed embodiments of the invention. The same is true for other odd integer multiples, such as 5×, 7×, 9×, etc. While four sets of slots are discussed in detail in this disclosure, those skilled in the art will appreciate that the antennas with six, eight, or more sets of slots are in accordance with the disclosed embodiments of the invention.

Figure 8:
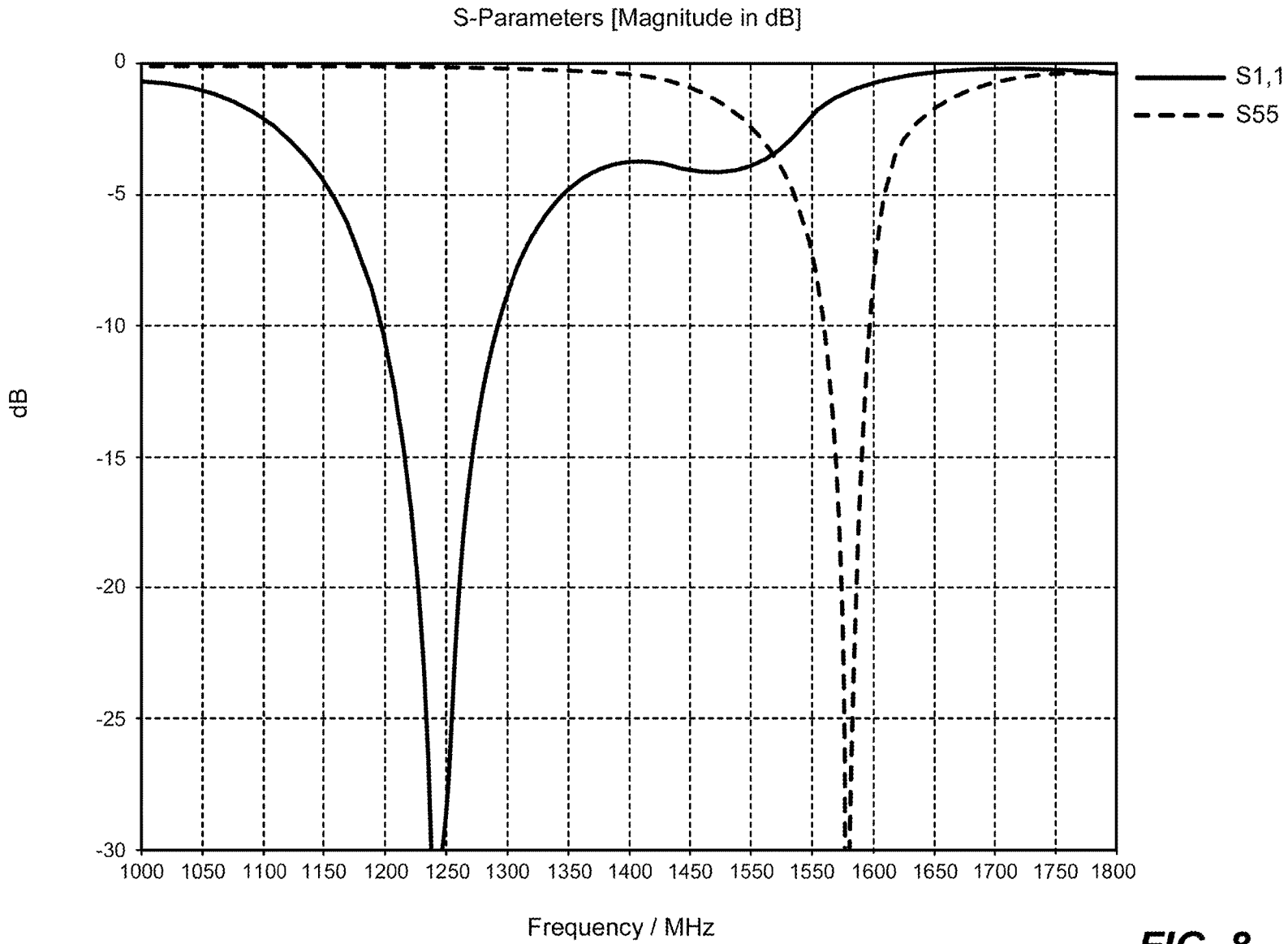
FIG. 8 shows the return loss of an exemplary antenna in accordance with the embodiment of FIG. 7.

FIG. 8 shows the return loss of an exemplary antenna in accordance with the embodiment of FIG. 7. As shown in FIG. 8, signals whose frequencies fall within 1164-1300 MHz and signals whose frequencies fall within 1525-1610 MHz have a greater return loss than signals outside the delineated ranges, with a maximum return loss more than 30 dB. The return loss is reported by simulations run on CST Microwave Studio 2020.

Figure 9:
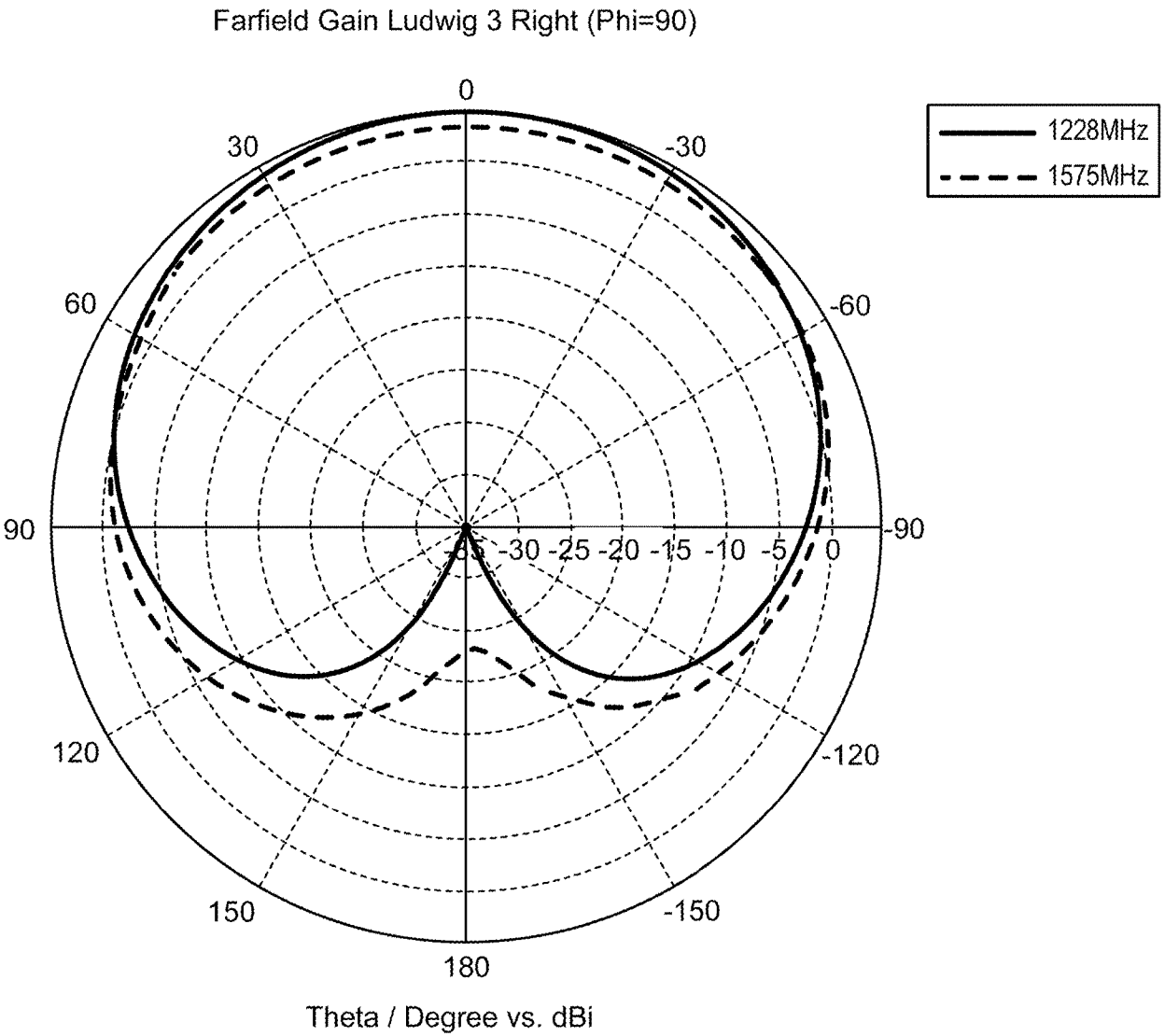
FIG. 9 shows a right-hand circular polarized pattern at low- and high-frequency bands of an exemplary antenna in accordance with the embodiment of FIG. 7.

FIG. 9 shows a right-hand circular polarized pattern at low- and high-frequency bands of an exemplary antenna in accordance with the embodiment of FIG. 7. As shown in FIG. 9, a broad axial beam is obtained with a half power beamwidth of about 120° and the front-back ratio is more than 20 dB, which shows a good resistance to multipath interference. The pattern is provided by simulations run on CST Microwave Studio 2020 with a calibrated right-hand circularly polarized helical antenna.

Figure 10:
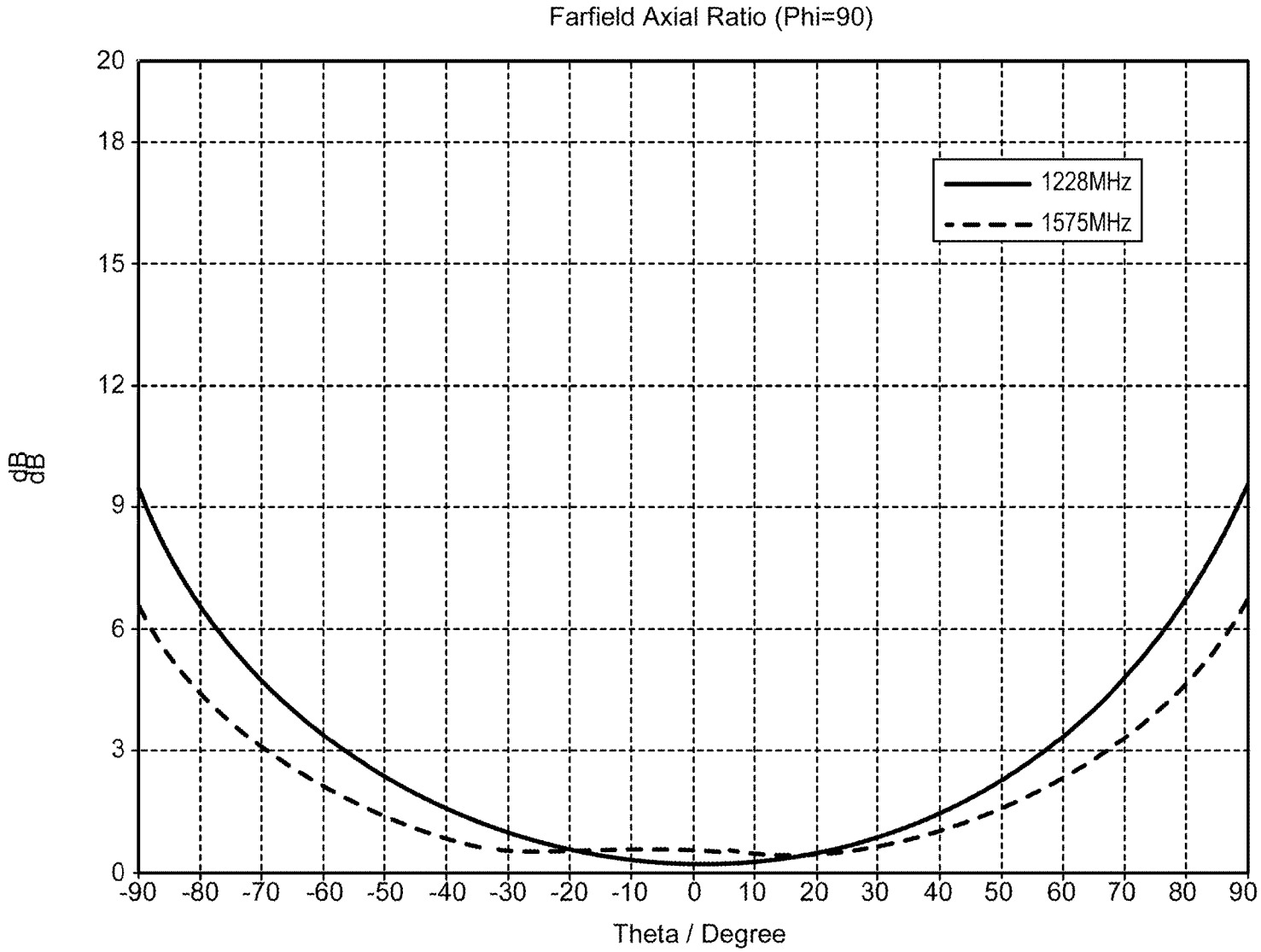
FIG. 10 illustrates the lower- and higher-frequency band axial ratios of an exemplary antenna in accordance with the embodiment of FIG. 7.

FIG. 10 illustrates the lower- and higher-frequency band axial ratios of an exemplary antenna in accordance with the embodiment of FIG. 7. As shown in FIG. 10, the axial ratio of this antenna is less than 3 dB for +/−60 degrees from the main beam, indicating that, within a range of 120 degrees, the circular polarization of a signal deviates only a small degree.

The embodiments of the present invention relate generally to a novel design for a dual-band or multiband quadrifilar helix antenna structure. While the preferred embodiments represent implementations primarily in GNSS survey applications, the design may be equally applied to other applications. Those skilled in the art will appreciate that, similar to conventional dipole or monopole antennas, the slot antenna can also be loaded with a higher dielectric constant material to reduce its size.

As used in this application, the term "approximately" refers to a variation of up to +/−5%. While certain embodiments have been described, these embodiments are presented by way of example only. They are not intended to limit the scope of the inventions. Indeed, the novel embodiments described herein may be embodied in a variety of forms consistent with the disclosed principles without departing from the spirit of the inventions. The accompanying claims and their equivalents set forth the scope of the inventions.

What is claimed is:

1. A quadrifilar helix antenna, comprising, a cylindrical body with a conductive layer;

a first slot disposed on the cylindrical body, wherein a length of the first slot is proportional to a first wavelength of a first signal;

a second slot disposed on the cylindrical body, wherein a length of the second slot is proportional to a second wavelength of a second signal, the second wavelength of the second signal is different from the first wavelength of the first signal, wherein the second slot is substantially parallel to the first slot and wherein the length of the second slot is different from the length of the first slot;

a first feed line crossing the first slot; and a second feed line crossing the second slot.

2. The antenna of claim 1, wherein the cylindrical body is connected to an electrical ground.

3. The antenna of claim 1, wherein the length of the first slot is approximately half of the first wavelength of the first signal.

4. The antenna of claim 1, wherein the length of the first slot is approximately one quarter the first wavelength of the first signal.

5. The antenna of claim 1, wherein the cylindrical body is made of a flexible printed circuit board.

6. The antenna of claim 1, wherein the first slot extends around the cylindrical body, in a helical configuration, by less than one full turn.

7. The antenna of claim 6, wherein the first slot extends around the cylindrical body, in a helical configuration, by approximately one-half turn.

8. The antenna of claim 1, wherein the first slot is approximately 3 mm wide.

9. The antenna of claim 1, wherein the first slot is approximately 4 mm wide.

10. The antenna of claim 1, further comprising a base attached to the cylindrical body.

11. The antenna of claim 1, wherein the first feed line and second feed line are formed by a single feed line that crosses both the first and second slots.

12. The antenna of claim 1, wherein at least one of the first feed line and the second feed line forms a short circuit through a metalized member.

13. A half wavelength quadrifilar helix antenna, comprising, a cylindrical body with a conductive layer;

a first slot disposed on the cylindrical body, wherein a length of the first slot is approximately one half of a first wavelength of a first signal;

a second slot disposed on the cylindrical body, wherein a length of the second slot is approximately one half of a second wavelength of a second signal and wherein the length of the second slot is different from the length of the first slot;

a first feed line crossing the first slot; and a second feed line crossing the second slot.

14. The antenna of claim 13, wherein the cylindrical body is connected to an electrical ground.

15. The antenna of claim 13, wherein at least one of the first slot and the second slot extends around the cylindrical body, in a helical configuration, by approximately one-half turn.

16. The antenna of claim 13, wherein at least one of the first feed line and the second feed line forms a short circuit through a metalized member.

17. A quarter wavelength quadrifilar helix antenna, comprising, a cylindrical body with a conductive layer;

a base attached to a lower end of the cylindrical body;

a first slot disposed on the cylindrical body, wherein a length of the first slot is approximately one quarter of a first wavelength of a first signal;

a second slot disposed on the cylindrical body, wherein a length of the second slot is approximately one quarter of a second wavelength of a second signal and wherein the length of the second slot is different from the length of the first slot;

a first feed line crossing the first slot; and a second feed line crossing the second slot.

18. The antenna of claim 17, wherein the cylindrical body is connected to an electrical ground.

19. The antenna of claim 17, wherein at least one of the first slot and the second slot extends around the cylindrical body, in a helical configuration, by approximately one-half turn.

20. The antenna of claim 17, wherein at least one of the first feed line and the second feed line forms a short circuit through a metalized member.

* * * * *